US005370085A

United States Patent [19]

Dangreau

[11] Patent Number: 5,370,085

[45] Date of Patent: Dec. 6, 1994

[54] STEAM GENERATOR WITH POROUS PARTITIONS

[75] Inventor: Bernard Dangreau, Landricourt, France

[73] Assignees: Trouvay & Cauvin, Asnieres, France; Armstrong International, Inc., Three Rivers, Mich.

[21] Appl. No.: 92,119

[22] Filed: Jul. 15, 1993

[30] Foreign Application Priority Data

Jul. 17, 1992 [FR] France ..... 9208838

[51] Int. Cl.[5] ..... F22B 1/00

[52] U.S. Cl. ..... 122/4 R; 122/44; 122/13.2

[58] Field of Search ..... 122/398, 4 R, 4 A, 13.1, 122/13.2

[56] References Cited

U.S. PATENT DOCUMENTS

| | | | |
|---|---|---|---|
| 1,994,331 | 3/1935 | Ziskin et al. . | |
| 2,933,460 | 4/1960 | Richter, Jr. et al. . | |
| 3,136,829 | 6/1964 | Skerritt . | |
| 3,188,061 | 6/1965 | Alguire . | |
| 3,386,711 | 6/1968 | Williams . | |
| 3,476,673 | 11/1969 | Stiles . | |
| 3,481,588 | 12/1963 | Lobb . | |
| 3,688,083 | 8/1972 | Rice et al. . | |
| 3,776,530 | 12/1973 | Griffith et al. . | |
| 4,007,114 | 2/1977 | Ostreicher . | |
| 4,146,775 | 3/1979 | Kirchner et al. . | |
| 4,157,963 | 6/1979 | Jessop et al. . | |
| 4,222,971 | 9/1980 | Eilert. . | |
| 4,257,989 | 3/1981 | Nishikawa . | |
| 4,631,135 | 12/1986 | Duddridge et al. . | |
| 4,638,766 | 1/1987 | Bunch et al. | 122/398 |
| 4,675,505 | 6/1987 | Fischer . | |
| 4,705,936 | 11/1987 | Fowler . | |
| 5,060,686 | 10/1991 | Troy . | |
| 5,088,518 | 2/1992 | Stamatakis et al. . | |

FOREIGN PATENT DOCUMENTS

| | | |
|---|---|---|
| 0240387A1 | 7/1987 | European Pat. Off. . |
| 2094930 | 4/1972 | France . |
| 2420731 | 10/1979 | France . |
| 715344 | 12/1941 | Germany . |
| 2236687A | 4/1991 | United Kingdom . |

OTHER PUBLICATIONS

Filtermat Type P15/150S, P15/350S, P15/500S, Data sheet, Freudenberg Nonwovens L.P., Viledon Filter Division, 1 page no date.

*Primary Examiner*—Edward G. Favors
*Attorney, Agent, or Firm*—Flynn, Thiel, Boutell & Tanis

[57] ABSTRACT

Steam generator comprising a supply of water to be evaporated, a steam outlet and a heat source, which steam generator is characterised in that it is formed by a casing subdivided into two chambers (2, 3) by a water-permeable porous partition (4), one (3) of the two chambers accommodating the heat source (6), the other chamber (2) receiving the supply water (5).

9 Claims, 4 Drawing Sheets

STEAM GENERATOR WITH POROUS PARTITIONS

The present invention relates to a steam generator comprising a supply of water to be evaporated, a steam outlet and a heat source.

Numerous types of steam generators exist, and the applications of such generators are manifold, including the supply of industrial steam, of steam used for humidifying air used in air-conditioning installations, etc.

One of the difficulties common to all these steam generators is that they use water of more or less natural origin, which has undergone practically no treatment and which is, because of this, loaded with numerous salts causing furring, the formation of foam and sludge, etc. which in particular foul the heating surfaces, impairing the operation of the generator by progressively reducing the heat exchange efficiency at the heat source and very quickly necessitating the replacement of the generator. Solutions have envisaged the periodic washing of the steam generator in order to remove the sludge, foam and deposits. However, these solutions are not very satisfactory and in addition have the drawback of necessitating shutdown of the steam production. Such a shutdown can only be envisaged in certain installations, and it is thus often necessary to duplicate the steam generator in order to allow continuous operation despite the shutdowns of operation for cleaning or washing or other actions often required.

The difficulty of the solution to this problem resides in the complexity of the fouling which can appear on the heating surfaces of the evaporators. The three main types are:

fouling with particles

This involves the deposition of material in suspension (fine particles of a fraction of a $\mu$m to several tens of $\mu$m) unavoidably carried in the water networks.

The deposition of particles on the wall is due to several phenomena, including:

the action of the brownian agitation of the molecules on the particle (perceptible for particle sizes $\leqq 0.01$ $\mu$m)

gravity (in relatively static systems and for particles of size $\geqq 1$ $\mu$m)

compaction under the effect of the centrifugal force (for systems in motion)

thermophoresis (the particles of size lying between 0.1 and 5 $\mu$m tend to diffuse towards the coldest regions of the system)

scaling

This involves the production of a crystalline solid from a liquid solution. Two conditions are necessary for scaling:

the limit of solubility of the salt in question must be exceeded the rate of deposition must be relatively fast.

corrosion

The products of the corrosion reactions produced on the surface foul the latter.

Scaling is principally precipitation of calcium salts and silica.

The main salts in question are:

calcium carbonate ($CaCO_3$) which precipitates when the temperature increases and forms either colloids or deposits. The solubility of $CaCO_3$ is 15 mg/l at 15° C. and decreases with temperature.

calcium hydrogen carbonate (more commonly bicarbonate) ($Ca(HCO_3)_2$) which is converted into $CaCO_3$ precipitate when the temperature rises. In brief the following reaction is shifted towards the right:

$$Ca(HCO_3)_2 \rightleftarrows CaCO_3 \downarrow + CO_2 \uparrow + H_2O$$

An entirely theoretical solution might consist in using demineralised water. This solution cannot be envisaged for reasons of cost and maintenance.

The object of the invention is to overcome the drawbacks of known solutions and proposes for this purpose the creation of a steam generator of the type defined hereinabove allowing extended operation with a quasi-constant efficiency to be ensured, that is to say the same efficiency of the steam generator after an extended period of use, without requiring washing of the generator and thus avoiding the problems of treating the water linked with this washing.

For this purpose, the invention relates to a steam generator corresponding to the type defined hereinabove, characterised in that it is formed by a casing subdivided into two chambers by a water-permeable porous partition, one of the two chambers accommodating the heat source, the other chamber receiving the supply water.

Surprisingly, this steam generator, even when used with very hard water containing a great deal of calcium carbonate and calcium hydrogen carbonate, operates excellently. Practically no deposition of fur is observed on the surface of the heat source immersed in the water to be evaporated. Furthermore, the steam released contains very few solid particles or those which risk solidifying.

Extremely complex physico-chemical phenomena which occur make it possible to trap the salts in the form of depositions in the porous participation and against it. In fact, a limited convection phenomenon occurs between the cold supply water introduced into the supply chamber and the water heated to boiling in the vaporisation chamber. The heat exchange takes place, as indicated, by convection but also by conduction, without however excessive circulation or agitation. The result is that the supply water which necessarily passes from the supply chamber to the boiling chamber containing the heat source is depleted in its mineral salts, either in the supply chamber or when passing through the porous wall. The results observed are excellent. After an extended period of operation, of the order of 2,000 hours, practically no deposition of fur on the heat source or of pieces of fur fallen to the bottom of the vaporisation chamber, under the heat source, is observed. In contrast, the salts are deposited in the form of sludge in the other chamber or in the partition, and, in the partition, practically no calcium compounds are present in the form of sludge or foam, but rather in the form of solid fur.

According to another advantageous characterisitic of the invention, the partition is made of a ceramic material or alternatively of fibres and in particular of a non-woven synthetic material mat. It should be pointed out that the deposition of the salts is promoted by the effect of deposition seeds constituted by the porous partition, in particular a fibre partition. Furthermore, these fibres do not risk being entrained in the water and in the steam, which gives an extremely pure steam which is highly advantageous for humidifying the air used for air-conditioning.

Particularly advantageously, the casing is a cylinder with a central tube in which the heat source is engaged, and two partitions which define with the casing two supply chambers and between them the chamber accommodating the heat source, the subdivided supply being connected onto the two chambers.

This embodiment of the steam generator is extremely simple and compact; it is easy to produce since it involves a tube fitted at each end with a partition, one of which includes the steam outlet nozzle and the other the water supply. Inside the tube, preferably along the axis, a tube is provided which opens out at both ends, such that the internal volume of the casing thus defined is a toric volume. The heat source, which is preferably an electrical resistor, is slid into this tube.

According to one variant embodiment, the electrical resistor is mounted fixed and the casing containing the partitions is mounted as a piece of equipment which can be moved in translation in order to allow it to be replaced. This replacement is performed after an extended period of use, when the partition or partitions are loaded with salts in the form of sludge or solid deposits. This avoids any onerous and dirty intervention at the installation itself, since it is sufficient to replace this cylinder with another cylinder. Another solution might consist in changing the porous partitions. This change can be performed either in situ, or in the workshop after removal of the casing, replacing the latter with a casing or a reconditioned casing, that is to say one which has for example received new partitions.

According to another advantageous characteristic, the steam outlet is separated from the inside of the casing by a porous partition. This partition completes the purification of the steam and ensures the deposition of the last crystallisable or depositable salts entrained by the steam. At the outlet, extremely pure steam is thus obtained.

The present invention will be described hereinbelow in more detail with the aid of the attached drawings, in which.

Figure 1:
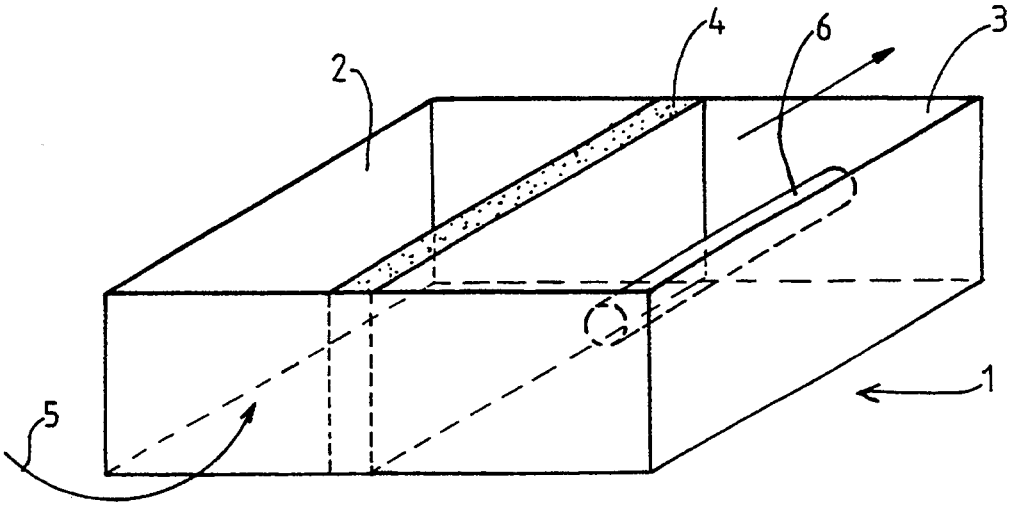
FIG. 1 is a diagrammatic perspective view of a steam generator according to the invention
Figure 2:
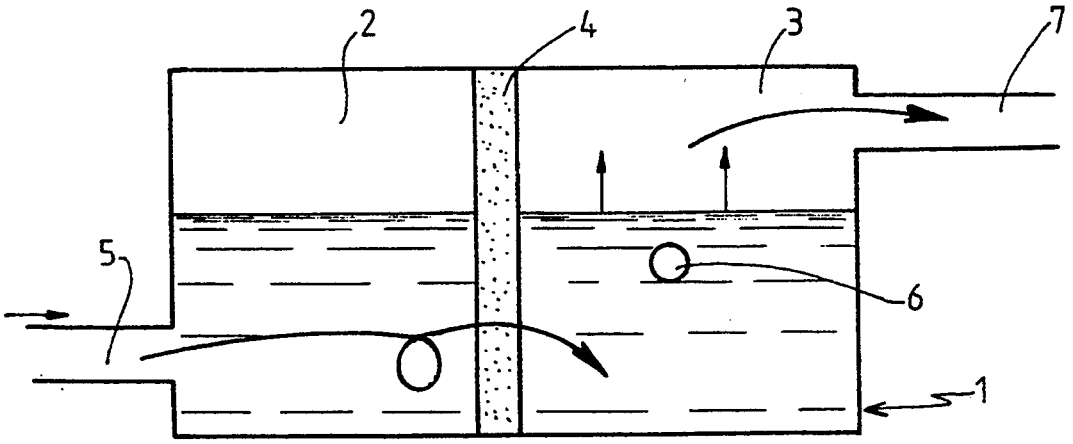
FIG. 2 is a diagrammatic sectional view of the steam generator in FIG. 1

According to FIGS. 1 and 2, the invention relates to a steam generator composed of a casing 1 subdivided into two chambers 2, 3 by a water-permeable porous partition 4. The chamber 2 is the supply chamber which receives the water through the supply 5; the chamber 3 constitutes the evaporation chamber and for this purpose contains the heat source 6. These two chambers 2, 3 allow exchange of water, that is to say passage of the water from the supply chamber 2 to the evaporation chamber 3 through the porous wall 4. Exchange may also occur in the opposite direction.

Although according to FIG. 2 the porous partition 4 completely separates the chamber 2 from the chamber 3, this is not necessarily so, and the partition 4 may not reach the upper wall of the casing 1. The steam is extracted through the duct 7.

The heat source 6 is preferably, but not necessarily, an electrical resistor embedded in a cylinder which is slid, for example, into the chamber 3, and in particular into a jacket placed in the chamber 3.

The porous wall 4 is a water-permeable porous wall. It may be a wall made of a porous ceramic or alternatively a wall of fibres, for example a mat of non-woven woven fibres, and in particular synthetic fibres.

Figure 3:
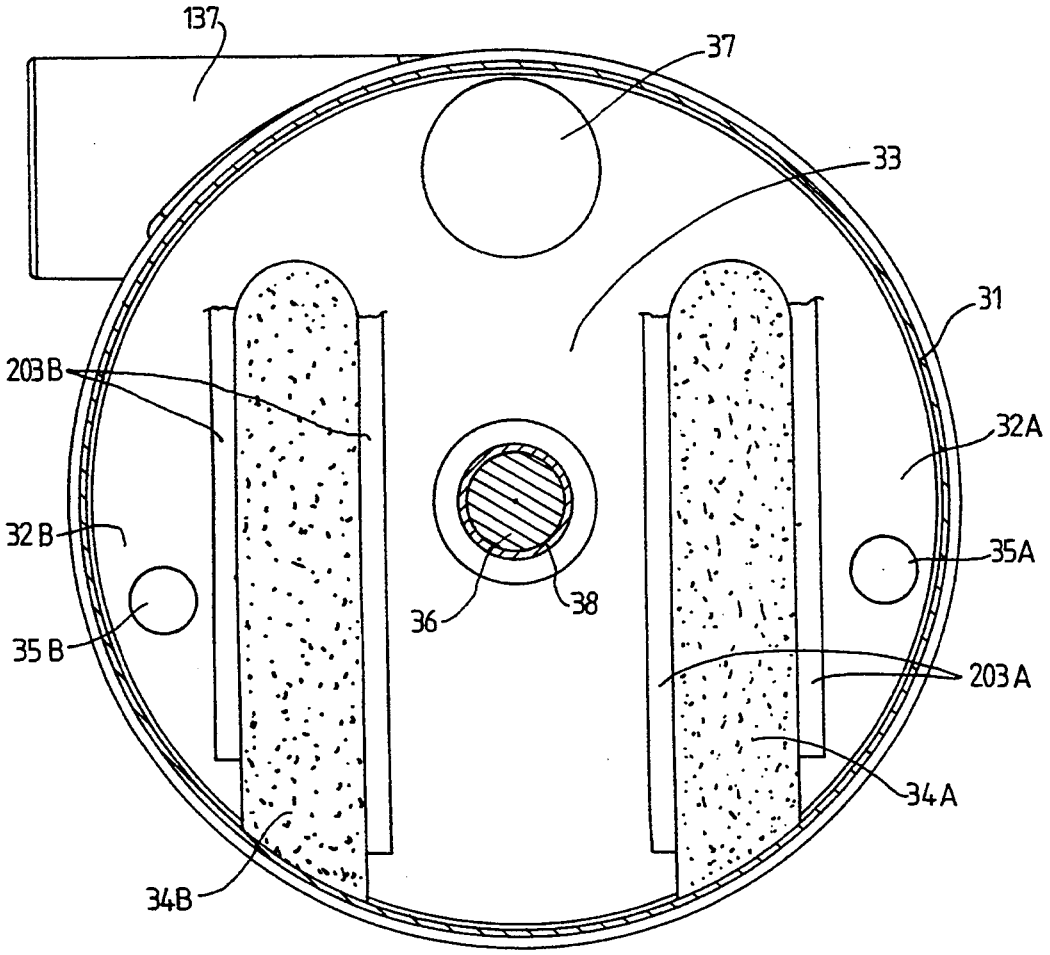
FIG. 3 is a sectional view of a steam generator corresponding to a preferred embodiment of the invention
Figure 4:
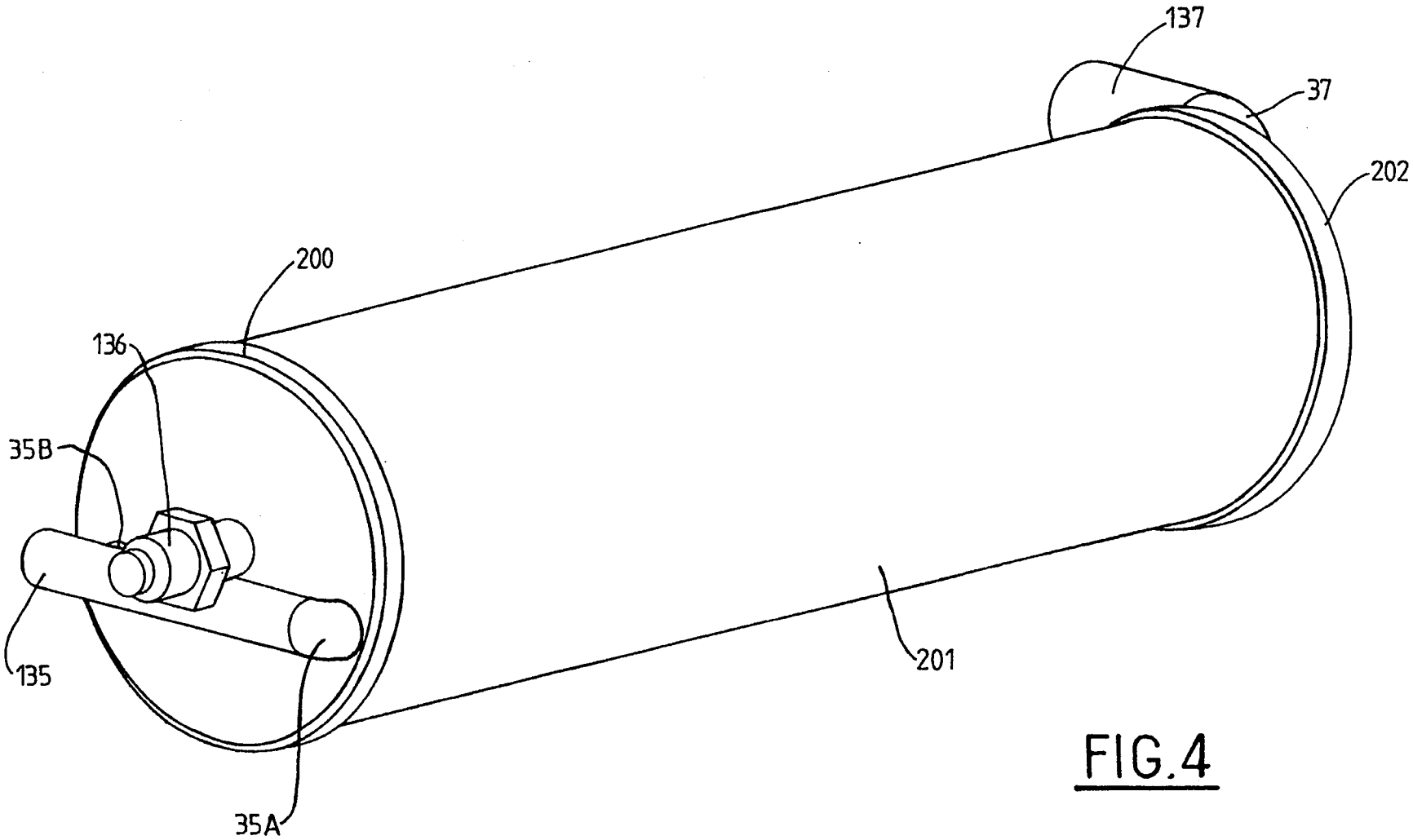
FIG. 4 is a perspective view of the steam generator represented in FIG. 3

FIGS. 3 and 4 diagrammatically show a first embodiment of the invention. Thus, the casing 31 consists of a cylinder of circular cross section containing two partitions 34A and 34B, defining two supply chambers 32A, 32B each between the partition 34A, 34B and the peripheral wall 31. Between the partitions 34A, 34B is situated the vaporisation chamber 33. The heat source 36 is placed in the axis inside a cylindrical sleeve 34. The steam outlet 37 is situated in the upper part, and the supply water inlets 35A, 35B open out into each of the chambers 32A, 32B. It should be noted that the water level inside the steam generator is adjusted so that the tube 38 accommodating the heat source 36 is completely immersed.

FIG. 4 shows in particular the head 136 of the resistor 36 and the manifold 135 connected to the two water supplies 35A, 35B.

The steam exits through the outlet 37 connected to the steam outlet nozzle 137. In order to simplify the embodiment, the water is supplied on the one side through a cover 200 fitted onto one end of the tubular body 201 forming the tank, and the steam exits through a cover 202 covering the other end of the tube 201. The covers 200, 202 preferably comprise fastening means 203A–203B (FIG. 3) holding the partitions 34A, 34B.

It should be noted that in the embodiment in FIGS. 3 and 4, the partitions 34A, 34B do not reach the upper part of the tank, so that the steam can pass into the steam outlet 37 either coming from the evaporation chamber 32 (most of the steam), or coming from the two supply chambers 32A, 32B.

Figure 5:
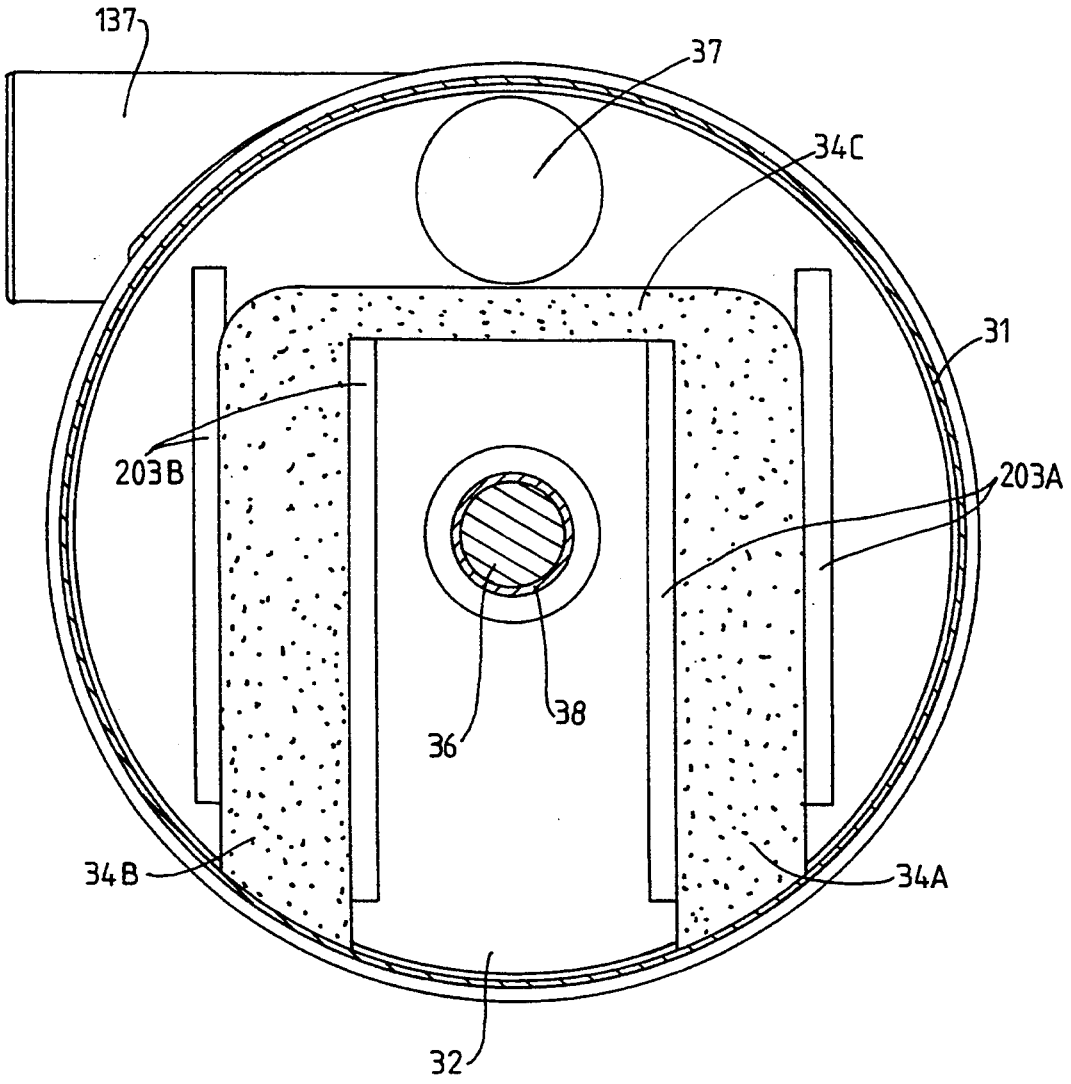
FIG. 5 is a sectional view of a steam generator variant according to FIGS. 3 and 4.

The embodiment in FIG. 5 differs from that in FIGS. 3 and 4 solely in that, in the upper part of the evaporation chamber 32, a partition 34C is provided joining the side partitions 34A, 34B. The steam freed in this steam chamber 32 is forced to pass through this partition, which forms a filter trapping an additional fraction of the solid elements or those which can be deposited and which are entrained by the steam.

The embodiment and its variant which are described hereinabove are particularly simple to implement. The generator constitutes a cartridge which is plugged onto the resistor which remains fixed to the framework of the steam generator, the casing and its tube forming the housing for the heat source which can be extracted or fitted by a simple translational movement. As already indicated hereinabove, the casing loaded with mineral salts and deposits can be changed at the end of a period which should be defined experimentally and which may be of the order of 2,000 hours, depending on the hardness of the water used. A cartridge thus removed can either be cleaned or reconditioned by replacement of the partitions, or scrapped.

As already mentioned, the porous partitions may be made of a water-permeable ceramic material or alternatively layers of non-woven fibres or non-woven fibre mats. The porous body, formed of ceramic or fibres, has a favourable effect on the deposition of the salts, by the effect of crystallisation seeding.

Tests carried out within the scope of the invention have shown that, despite the continous supply of dissolved minerals, the total hardness of the water contained in the evaporator (upstream and downstream of the filter) is lower than in the water from the network. There is therefore almost total thermal decarbonation of the supply of water.

The calcium hydrogen carbonate is precipitated as calcium carbonate under the effect of heat. This is deposited in and on the porous body. It is observed that, in ceramic fibre evaporators, the surface deposition is favoured over bulk deposition. In contrast, in synthetic filter evaporators, the surface deposition is very low with respect to the bulk deposition. This is due to the apparent density of the ceramic fibre filter, which is greater than the apparent density of the synthetic media. The filter constitutes an excellent support for the formation and the deposition of the fur.

According to the generators which were used for the tests, the deposit remains attached to the tube in which the resistor slides, and in this case it is the increase of the calcium deposit which makes it possible to measure the lifetime of the steam generator.

In the case of a resistor used directly, the fur deposits are periodically detached by the opposing phenomena of expansion. These deposits fall to the bottom of the tank.

After 2,000 hours of operation, it is observed that in the evaporators equipped with filters, the mineral deposits are denser than in the evaporators without a filter, in which most of the deposits occur in the form of dludge. A plurality of phenomena should be considered:

It would seem that the presence of the filter limits the convection, whereas, in contrast, convection causes grouping of the particles in suspension into a bulky sludge.

In addition, minerals build up more in a steam generator equipped with a filter than in a generator without a filter. In the case of operation without drainage of the humidifier, the stored volume is the essential parameter effecting the lifetime of the vaporisation system.

Finally, it should be pointed out that the heat source constituted by an electrical resistor is the most flexible heat source to install and adjust. However, under certain conditions, this heat source may also be replaced by a coil passed through by a heat-exchange fluid. The results of the invention are the same.

I claim:

1. Steam generator comprising a supply of water to be evaporated, a steam outlet and a heat source, which steam generator is formed by a casing subdivided into two chambers by a water-permeable porous partition, one of the two chambers accommodating the heat source, the other chamber receiving the supply water.

2. Steam generator according to claim 1, in which the partition is made of a ceramic material or fibers, in particular a non-woven synthetic fiber mat.

3. Steam generator according to claim 1, in which the casing is a cylinder with a central tube in which the heat source is engaged, and two partitions which define with the casing two supply chambers and between them the chamber accommodating the heat source, the subdivided supply being connected onto the two chambers.

4. Steam generator according to claim 1, in which the other chamber comprises at least one steam emission chamber, and the steam outlet is separated from the steam emission chamber or chambers by the porous partition.

5. Steam generator according to claim 1, including an interchangeable assembly which accommodates the heat source.

6. Steam generator according to claim 2, in which the casing is a cylinder with a central tube in which the heat source is engaged, and two partitions which define with the casing two supply chambers and between them the chamber accommodating the heat source, the supply being subdivided and connected onto the two chambers.

7. Steam generator according to claim 2, including an interchangeable assembly which accommodates the heat source.

8. Steam generator according to claim 3, including an interchangeable assembly which accommodates the heat source.

9. Steam generator according to claim 4, including an interchangeable assembly which accommodates the heat source.

* * * * *